United States Patent [19]

Daikoku et al.

[11] Patent Number: 4,979,480

[45] Date of Patent: Dec. 25, 1990

[54] FUEL INJECTION SYSTEM FOR MULTIPLE CYLINDER TWO-CYCLE ENGINE

[75] Inventors: Keisuke Daikoku; Nobuyuki Shoumura, both of Hamamatsu, Japan

[73] Assignee: Suzuki Jidosha Kogyo Kabushiki Kaisha, Shizuoka, Japan

[21] Appl. No.: 381,353

[22] Filed: Jul. 18, 1989

[30] Foreign Application Priority Data

Jul. 19, 1988 [JP] Japan ..... 63-178188

[51] Int. Cl.[5] ..... F02M 51/00

[52] U.S. Cl. ..... 123/478; 123/480

[58] Field of Search ..... 123/478, 480, 492

[56] References Cited

U.S. PATENT DOCUMENTS

| | | | |
|---|---|---|---|
| 4,753,206 | 6/1988 | Inoue et al. | 123/480 |
| 4,754,735 | 7/1988 | Simons | 123/478 |
| 4,821,698 | 4/1989 | Atago et al. | 123/478 |
| 4,825,834 | 5/1989 | Toshimitsu et al. | 123/478 |
| 4,829,966 | 5/1989 | D'Angelo et al. | 123/478 |

*Primary Examiner*—Raymond A. Nelli

*Attorney, Agent, or Firm*—Schwartz & Weinrieb

[57] ABSTRACT

A fuel injection system for a multiple cylinder two-stroke cycle engine having a plurality of cylinders provided with intake manifolds, respectively, comprises a plurality of fuel injectors each operatively connected to its respective intake manifold, a controlling unit operatively connected to the fuel injectors for controlling fuel injection of the fuel injectors, and a unit operatively connected to the fuel injection controlling unit for detecting the revolution number or speed of the engine. The fuel injection controlling unit includes a micro computer for carrying out calculations in response to information from the engine revolution operation detecting unit so as to inject the fuel a plurality of times with equal angular intervals defined therebetween during one revolution of the engine, or the crank shaft, during the neutral and low revolution periods of the engine. The fuel injection system may further comprise an ignition timing controlling unit including a pick-up signal processing circuit through which the engine revolution operation detecting unit is connected to the micro computer of the fuel injection controlling unit so as to transfer the information representing the engine revolution number or speed from the engine revolution operation detecting unit to the fuel injection controlling unit.

9 Claims, 4 Drawing Sheets

FUEL INJECTION SYSTEM FOR MULTIPLE CYLINDER TWO-CYCLE ENGINE

FIELD OF THE INVENTION

This invention relates to a fuel injection system for a multiple cylinder two-stroke cycle engine improved so as to prevent the dispersion of the air/fuel ratio of a fresh air-fuel mixture of air and fuel introduced into the respective cylinders of the engine.

BACKGROUND OF THE INVENTION

In connection with a conventional two-stroke cycle engine provided with a crank chamber, an intake port having an opening which is open to the crank chamber is communicated with an intake passage. A scavenge port and an exhaust port are also opened within the peripheral wall of the cylinder. The exhaust port is communicated with an exhaust passage and the scavenge port is provided with a scavenge passage communicating with the crank chamber. The scavenge port and the exhaust port are opened and closed at predetermined times by means of the displacement of a piston disposed in association with each cylinder so that the fresh air-fuel mixture, called merely the mixture hereinafter, sucked into the crank chamber through means of the intake port is compressed as a result of the lowering of the piston and the compressed mixture is fed into the cylinder chamber through means of the scavenge port and then exhausted through means of the exhaust port.

With the two-stroke cycle engine having the structure described above, however, there is developed a spitting phenomenon in which the mixture conducted into the crank case is reversely conducted into a carburetor by means of the pressure of the piston.

For example, with the multiple cylinder two-stroke cycle engine, pressure variations, that is, pulsations, are caused by means of the rotation of the crank shaft, within the respective intake passages and, hence, the fresh mixture is accordingly pulsated. In the instance that this pulsation is substantially large, the spitting phenomenon of the fresh mixture may develop within the intake passages. This may result in the fluctuation of the air/fuel ratios of the fresh mixtures conducted into the respective cylinders.

Furthermore, there is also provided a multiple cylinder two-stroke cycle engine having intake passages injectors are arranged in place of the carburetors upon the upstream sides of lead valves.

With the engine of this type, in the case where the fuel is injected simultaneously from the respective injectors during the neutral or low revolution operation of the engine, an instance may occur wherein the fuel injection timing accords with the generation of the reverse flow of the fresh mixture within a particular one of the multiple cylinders. In such a case, air and fuel adversely flow from that cylinder into the other cylinders in which the fuel injection accords with the rectification of the mixture.

During the engine operation periods at the neutral or low revolution number values or levels of the engine, the fuel injection time is short, so that when the air and fuel are not uniformly distributed or conducted into the respective cylinders the concentration of the mixture differs within the different cylinders and, the injection and the rectification of the fuel mixture within the other cylinders are carried out during the same time periods. This adversly results in the fluctuation of the air/fuel ratio of the fresh mixture with respect to the respective cylinders.

Such adverse phenomenon may be caused in a case where the fuel injectors are arranged upon the downstream side of the lead valves.

OBJECT OF THE INVENTION

An object of this invention is to substantially eliminate the defects and drawbacks of the prior art described above and to provide a fuel injection system for a multiple cylinder two-stroke cycle engine capable of substantially uniformly distributing the air/fuel ratio of a fresh air-fuel mixture conducted into the respective cylinders of the engine during the neutral or low revolution periods of operation of the engine.

SUMMARY OF THE INVENTION

The foregiong and other objects can be achieved according to this invention by providing a fuel injection system for a multiple cylinder two-stroke cycle engine having a plurality of cylinders provided with intake manifolds, respectively, comprising a plurality of fuel injectors each operatively connected to the intake manifolds, a controlling unit operatively connected to the fuel injectors for controlling fuel injection of the fuel injectors, and a unit operatively connected to the fuel injection controlling unit for detecting the revolution operation of the engine, the fuel injection controlling unit including a micro computer for carrying out calcuations in response to information from the engine revolution operation detecting unit so as to inject the fuel a plurality of times with equal angular intervals defined therebetween during one revolution of the engine, that is, during one revolution of the crank shaft, during neutral and low revolution operation periods of the engine.

The fuel injection system further comprises an ignition timing controlling unit including a pick-up signal processing circuit through which the engine revolution operation detecting unit is connected to the micro computer of the fuel injection controlling unit.

According to the fuel injection system of the character described above, the micro computer calculates the fuel injection times so that the fuel injector injects the fuel a plurality of times during one revolution period of the engine, that is, during one revolution of the crank shaft, during the neutral and low revolution operation periods of the engine.

According to the embodiment of this invention, as described above, each of the fuel injectors is controlled in accordance with the one-revolution plural-time-injection mode during the neutral or low revolution number operational periods of the engine, so that even if the spitting phenomenon is developed within any one of the cylinders at the same time as that of one of the plurality of fuel injections, the spitting phenomenon is not developed within the other fuel injection times, whereby the air/fuel ratio of the fresh mixture induced into that one cylinder is not largely different from those induced into the other cylinders, thus substantially uniformly distributing the air/fuel ratios of the mixtures induced into the respective cylinders.

BRIEF DESCRIPTION OF THE DRAWINGS

Various other objects, features, and attendant advantages of the present invention will be more fully appreciated from the following detailed description when considered in connection with the accompanying drawings, in which like reference characters designate like or corresponding parts throughout the several views, and wherein.

DETAILED DESCRIPTION OF THE PREFERRED EMBODIMENTS

For a better understanding of this invention, the prior art technology in this technical field will be described first with reference to FIGS. 6 and 7 before the description of preferred embodiments according to this invention.

Figure 6:
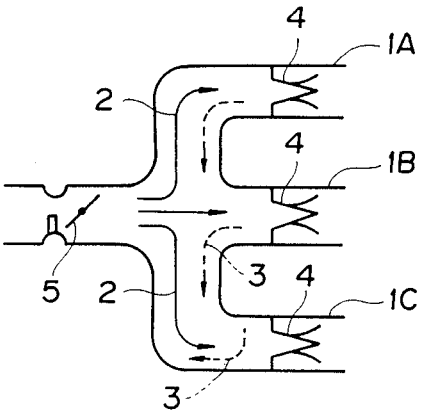
PRIOR ART FIG. 6
FIGS. 6 and 7 are brief illustrations for the explanation of the spitting phenomenon within the intake manifold of a conventional fuel injection system.

Referring to FIG. 6 showing an illustration of an intake manifold for multiple cylinder two-stroke cycle engine of the conventional type, pressure variations, that is, pulsations, are sometimes caused during one revolution of the crank shaft, not shown, within the respective intake passages 1A, 1B and 1C and, hence, the fresh air-fuel mixture is accordingly pulsated. In the instance that this pulsation becomes large, there may result a spitting phenomenon with respect to the mixture within the intake passages 1A, 1B and 1C within which the mixture is reversely conducted as shown by means of the dotted lines in FIG. 6. This may result in the fluctuation of the air/fuel ratios of the fresh mixtures conducted into the respective cylinders. In FIG. 6, reference numerals 4 and 5 designate lead valves and a throttle valve respectively.

Figure 7:
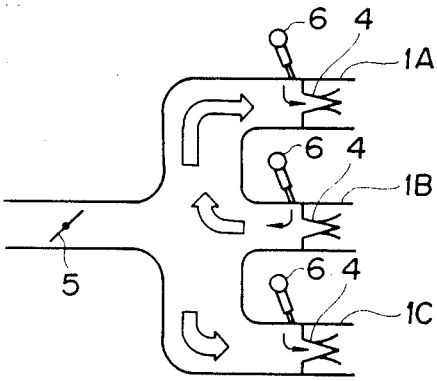
PRIOR ART FIG. 7

Furthermore, as shown in FIG. 7, there is also provided a multiple cylinder two-stroke cycle engine having intake passages 1A, 1B and 1C connected to the respective cylinders in which fuel injectors 6 are arranged in place of carburetor upon the upstream sides of lead valves 4.

With the engine of this type, in the case where the fuel is injected simultaneously from the respective injectors 6 during the neutral or low revolution operational periods of the engine, there may develop an instance wherein the fuel injection timing accords with the generation of the reverse flow of the mixture within a particular one of the multiple cylinders. In such a case, air and fuel are reversely conducted from the cylinder communicating with the intake passage 1A for example, into the cylinder communicating with the intake passage 1B within which the fuel injection accords with the rectification of the mixture. Referring to FIG. 7, solid lines show the flow of the fuel and outlined lines show the flow of the air.

During the neutral of low revolution operational periods of the engine, the fuel injection time is short, so that when the air and fuel are not uniformly distributed or conducted into the respective cylinders, the concentration of the mixture within the cylinder connected to the intake passage 1A becomes high, for example, and the concentration thereof within the cylinder connected to the intake passage 1B becomes low. Furthermore, in either one of the intake passages 1A, 1B and 1C connected to their respective cylinders, the injection of the injector 6 and the generation of the reverse flow of the mixture is coincident. This adversely results in the fluctuation of the air/fuel ratio of the fresh mixture within the respective cylinders with respect to the revolutions of the engine, thus finally adversely affecting the engine operation.

Such adverse phenomenon may also be caused in a case wherein the fuel injectors 6 are arranged upon the downstream side of the lead valves 4.

This invention conceived by taking the prior art technology described above into consideration will now be described with reference to FIGS. 1 to 5.

Figure 1:
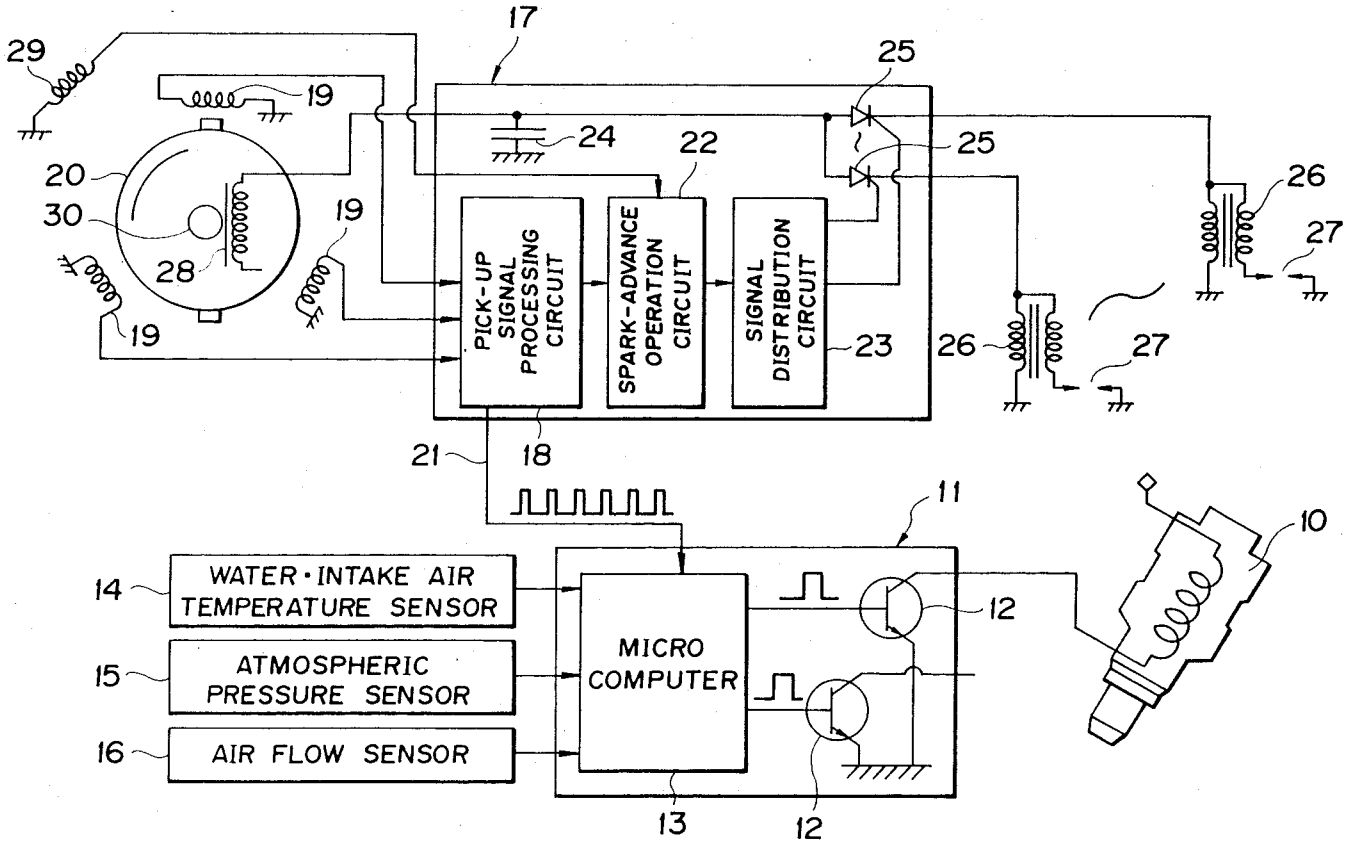
FIG. 1 is a diagram showing the construction of one embodiment of a fuel injection system for a multiple cylinder two-stroke cycle engine according engine to this invention.
Figure 2:
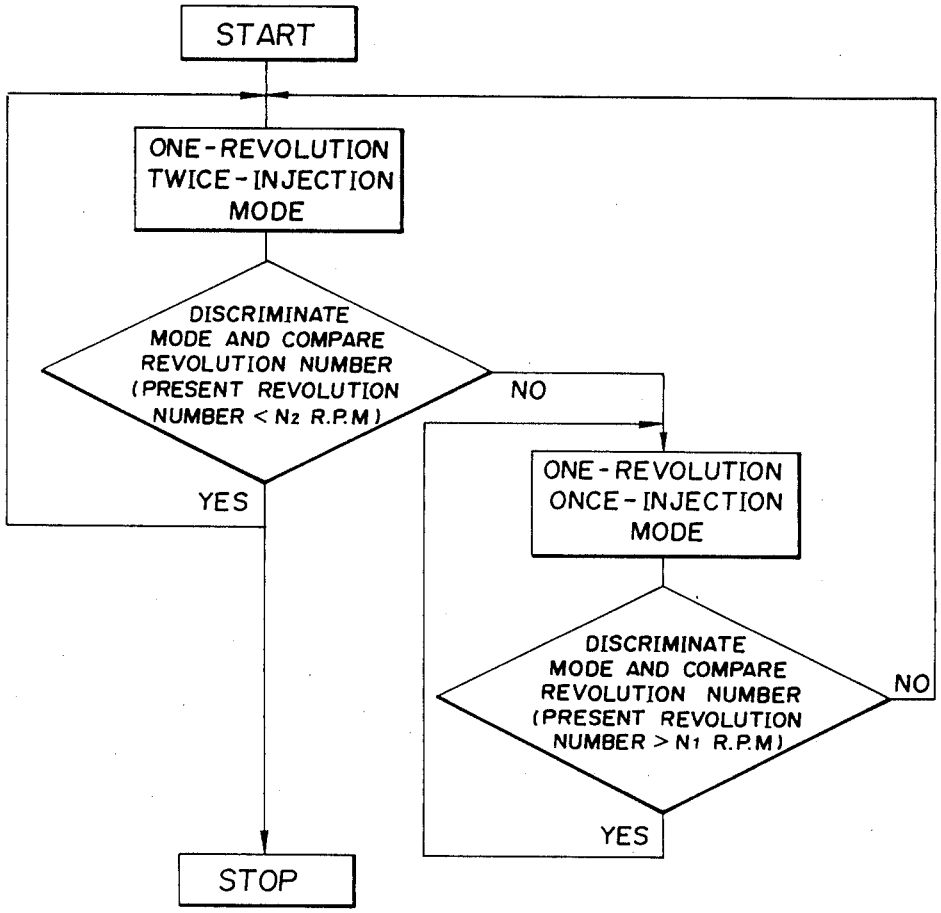
FIG. 2 is a flow chart for the operation of a micro computer included within the fuel injection system shown in FIG. 1.

FIG. 1 shows a circuit diagram representing a fuel injection system of one embodiment of a multiple cylinder two-stroke cycle engine constructed according to this invention.

Intake manifolds are connected to the cylinders of the multiple, such as, for example, six, cylinders of a two-stroke cycle engine respectively in a branched manner and a fuel injector 10 is operatively connected to each one of the branched intake manifolds. Referring to FIG. 1, the fuel injectors 10 are connected to transistors 12 of a fuel injectors control unit 11, respectively. The fuel injection control unit 11 includes a micro computer 13 serving as a calculating means in addition to the transistors 12.

Various kinds of sensors such as, for example, water and intake air temperature sensor 14, an atmospheric pressure sensor 15 and an air flow sensor 16 are operatively connected to the micro computer 13. The air flow sensor 16 serves to detect the intake air amount as a voltage variation variation and a signal representing the voltage variation is transmitted into the micro computer 13. The water and intake air temperature sensor 14 serves to detect the temperature of the intake air to detect the temperature of the cooling water for the engine.

The micro computer 13 is connected to a pick-up signal processing circuit 18 of an ignition timing control unit 17. The pick-up signal processing circuit 18 is connected with a plurality such as, for example, three, as seen illustration, of pick-up coils 19, which detect the revolution, every 60°, of a magnet rotor 20 of a flywheel magnet type generator.

The pick-up signal processing circuit 18 processes pulse signals detected by means of the pick-up coils 19 and transmits ignition pulse signals 21 into the micro computer 13. The ignition pulse signal 21 comprises six pulses during one rotation of the crank shaft because the magnet rotor 20 is directly coaxially connected to the crank shaft as briefly illustrated by means of the reference numeral 30. The micro computer 13 confirms the revolution numbers of the crank shaft through means the of transmission of the ignition pulse signal 21. Accordingly, the pick-up coils 19 and the pick-up signal processing circuit 18 constitute an engine revolution number detection sensor.

The ignition timing control unit 17 includes, in addition to the pick-up signal processing circuit 18, a spark-advance operation circuit 22, a signal distribution circuit 23, a capacitor 24 and a plurality of thyristors 25, such as, for example, six.

Each of the thyristors 25 is connected to an ignition plug 27 through means of an ignition coils 26. The capacitor 24 is connected to a capacitor charge coil 28 of the fly-wheel magnet type generator and is also connected to the thyristors 25 so as to accumualate alternating current generated within the capacitor charge coil 28 for the capacitor 24. The spark-advance operation circuit 22 is connected to the pick-up signal processing circuit 18 and a gear count coil 29 so as to determine the ignition timing in response to an ignition pulse signal 21 from the pick-up signal processing ciruit 18 and a signal from the gear count coil 29, and to transmit a signal representing the ignition timing to the signal distribution circuit 23. The signal distribution circuit 23 distrtibutes the inputted signal from circiut 22 to the respective thyristors 25 as trigger pulse signals. The repective thyristors 25 are activated to their ON states by means of application of the trigger signals from the signal distribution circuit 23 to the gates of the thyristor 25. Accordingly, the power charged within the capacitor 24 is discharged towards the primary coil of the ignition coil 26 so as to generate a high voltage within the secondary coil of the ignition coil 26, whereby a spark is generated within the ignition plug 27.

Figure 4A:
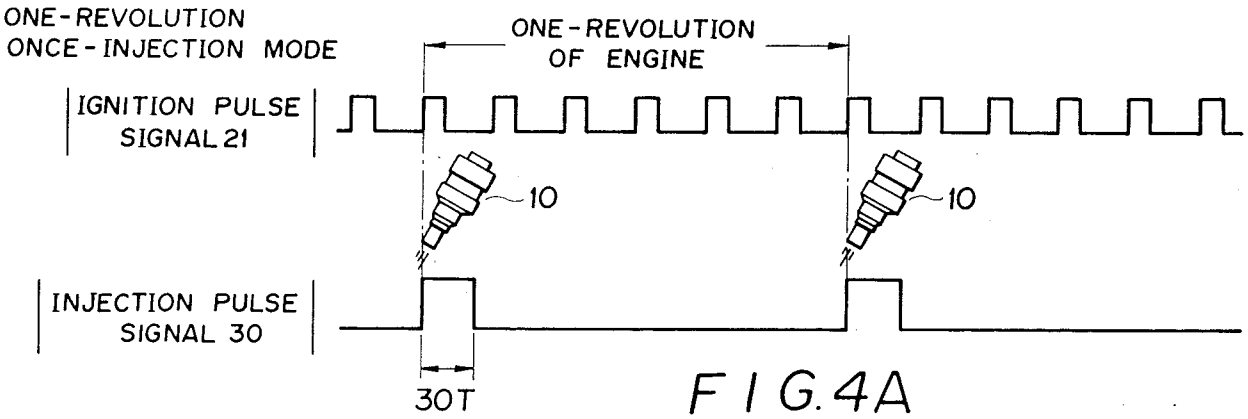
FIGS. 4A and 4B are views representing the engine one-revolution once-injection mode and the engine one-revolution twice-injection mode, respectively.
Figure 4B:
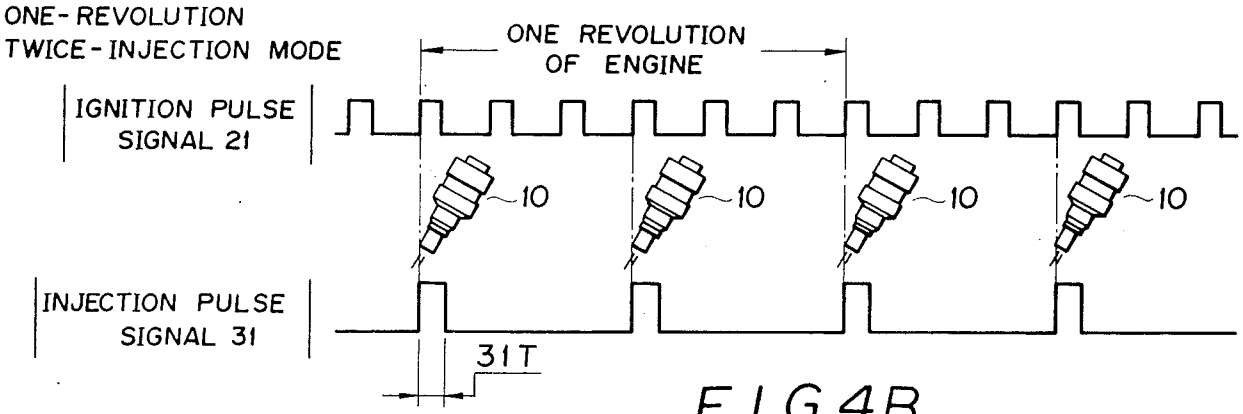
Figure 5:
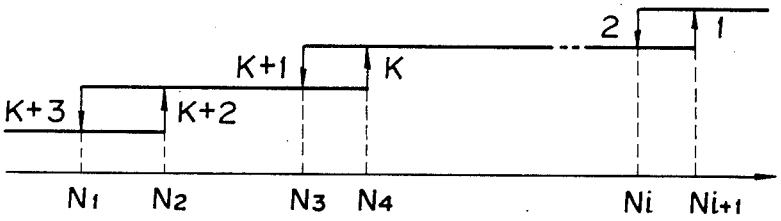
FIG. 5 is a view similar to FIG. 3 representing the same relationship of another example.

The micro computer 13 of the fuel injection control unit 11 serves to control the fuel injectors 10 so as to change over the fuel injection modes of the fuel injectors 10 in response to the revolution operation generally represented by means of revolution number of the engine. Two typical examples of fuel injection modes are represented in FIGS. 4A and 4B. FIG. 4A represents the first injection mode in which the fuel is injected from each fuel injector 10 one time for every six pulses of the ignition pulse signals 21, that is once for each revolution of the engine, or the crank shaft, (that is, the fuel is injected once for each one revolution of the engine; or other words, in a one-revolution once-injection mode) during the engine high revolution operational period and this injection mode is managed by means of injection pulse signal 30 transmitted from the micro computer 13. On the other hand, FIG. 4B represents the second injection mode in which the fuel is injected from each fuel injector 10 once every three pulses of the ignition pulse signals 21 (that is, the fuel is injected twice for each one revolution of the engine, that is, each one revolution of the crank shaft; or in other words, in a one-revolution twice-injection mode) during the engine neutral or low revolution operational periods and this injection mode is managed by means of injection pulse signal 31 transmitted from the micro computer 13.

The injection time periods 30T and 31T injection pulse signals 30 and 31 will be determined by means of the following equations, respectively:

,0140

In these equations, the effective injection time period is detemined by implementing revisions in response to the intake mixture temperature and the atomspheric pressure to the injection time period originally prepared on the basis of the intake mixture amount and the engine revolution number. On the other hand, the ineffective injection time period is determined by means of the delayed time between the inputting of the injection pulse signals 30 and 31 into the fuel injectors 10 and the actual operational start thereof. The injection time periods 30T and 31T are set within a range by means of these periods are not shorter than the minimun injecting time period and the minimum injection stop time period for every one revolution of the engine.

Figure 3:
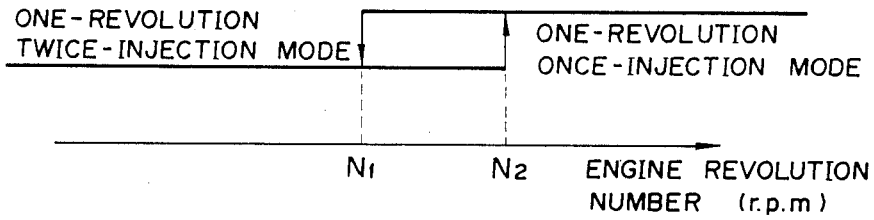
FIG. 3 is a view representing the relationship between the fuel injection modes and the mode change-over revolution numbers.

The change-over revolution numbers of the one-revolution once-injection mode and the one-revolution twice-injection mode are represented by means of r.p.m. and $N_2$ r.p.m. as shown in FIG. 3. In the case of having only one change-over revolution number, that is, $N_1$, the fuel injection mode would be changed over where the engine revolution number changes slightly or within the vicinity of the change-over revolution numbe $N_1$ even when the degree of opening of the throttle valve is made constant and, hence, the revolution number mode of operation of the engine would often be changed. For this reason, according to this invention, the revolution number for changing the mode of operation is defined at two values $N_1$ and $N_2$. During operation of the engine within the one-revolution twice-injection mode, this injection mode is changed over to the one-revolution once-injection mode at the revolution number $n_2$ and in the case the operation of the engine within the one-revolution, once-injection mode, of the one-revolution once- injection mode is changed over to the one-revolution twice-injection mode at the revolution number $N_1$.

The operation of each fuel injector according to this invention and of the character described above will be described hereunder.

During the engine operation period within the neutral or low revolution mode number, the micro computer 13 controls the injection timing of each fuel injector 10 in accordance with the one-revolution twice-injection mode. When the revolution number of the engine increases over the revolution number $n_2$, the micro computer 13 operates so as to select the one-revolution once-injection mode and each fuel injector 10 is controlled in accordance with this mode during the engine operation period at the high revolution number level. When the revolution number of the decreases below the revolution number $N_1$, the micro computer 13 operates so as to select the one-revolution twice-injection mode and each fuel injector 10 is controlled in accordance with this mode during the engine operation period at the neutral or two revolution number level.

According to this embodiment, as described hereinbefore, the fuel injector 10 is controlled in accordance with the one-revolution twice-injection mode during the engine operation period at the neutral or low revolution number level, so that even if the spitting phenomenon is generated within any one of the cylinders at the same time as that of one of the two fuel injections, the spitting phenomenon is not caused during the other one of the fuel injection periods, whereby the air/fuel ratio of the fresh mixture induced within that cylinder is not significantly different from that within the other cylinders, thus substantially uniformly distributing the air/fuel ratios of the mixtures induced into the respective cylinders.

It is to be understood that this invention is not limited to described embodiments but many other changes and modifications may be made without departing from the sprit and scope of the invention as defined within the appended claims.

For example, in accordance with the described embodiment, reference is made to the one-revolution twice-injection mode of the fuel injectors by means of which the fuel is injected twice from each fuel injector 10 during one revolution of the engine during the engine operation period at the neutral or low revolution number level, however, the fuel injectors 10 may be controlled so as to inject the fuel three or more times as long as the injection time is not beyond the limits of the minimum injection time period and the minimum injection stop time period during one revolution of the engine.

What is claimed is:

1. A fuel injecting system for an engine having a plurality of cylinders and an intake manifolds, comprising:

a plurality of fuel injector each operatively connected to intake manifold;

means operatively connected to said fuel injectors for controlling fuel injection of said fuel injectors; and means operatively connected to said fuel injection controlling means for detecting the revolution speed of said engine;

said fuel injection controlling means including computer means for controlling said fuel injectors in response to information received from said engine revolution speed detecting means so as to inject said fuel from said fuel injectors at least twice during one revolution of said engine when said revolution speed of said engine is below a first predetermined revolution speed value, and once during one revolution of said engine when said revolution speed of said engine is above a second predetermined revolution speed value which is greater than said first predetermined revolution speed value.

2. A fuel injection system according to claim 1, wherein:

said fuel injectors inject said fuel at least twice during one revolution of said engine with equal angular intervals of said engine revolution being defined between said fuel injection times.

3. A fuel injection system according to claim 2, wherein said fuel injectors inject the fuel twice with equal angular intervals defined therebetween during one revolution period of the engine.

4. A fuel injection system according to claim 1, wherein said fuel injection controlling means further includes a water and intake air temperature sensor, an atmospheric pressure sensor and an air flow sensor, which are operatively connected to said computer means.

5. A fuel injection system according to claim 1, further conmprising an ignition timing controlling means including a pick-up signal processing circiut through which said engine revolution period detecting means is connected to said computer means of the fuel injection controlling means.

6. A fuel injection system as set forth in claim 1, wherein:

said plurality of fuel injectors are respectively disposed within a plurality intake manifolds.

7. A fuel injection system as set forth in claim 1, wherein:

said engine comprises a two-stroke cycle engine.

8. A fuel injection system as set forth in claim 1, wherein:

said fuel injection controlling means causes injection of said fuel from said fuel injectors at least three times during one revolution of said engine when said revolution speed of said engine is below said first predetermined revolution speed value.

9. A fuel injection system as set forth in claim 1, wherein:

said engine comprises six cylinders.

* * * * *